US010058913B2

(12) United States Patent
Wang et al.

(10) Patent No.: US 10,058,913 B2
(45) Date of Patent: Aug. 28, 2018

(54) LOW-PRESSURE CASTING BOTTOM MOLD FOR ALUMINUM ALLOY HUB

(71) Applicant: CITIC Dicastal CO., LTD., Qinhuangdao, Hebei (CN)

(72) Inventors: Kaiqing Wang, Qinhuangdao (CN); Hongbiao Li, Qinhuangdao (CN); Xu Wang, Qinhuangdao (CN); Changhai Li, Qinhuangdao (CN)

(73) Assignee: CITIC Dicastal CO., LTD., Qinhuangdao, Hebei (CN)

( * ) Notice: Subject to any disclaimer, the term of this patent is extended or adjusted under 35 U.S.C. 154(b) by 0 days.

(21) Appl. No.: 15/609,613

(22) Filed: May 31, 2017

(65) Prior Publication Data

US 2017/0361371 A1 Dec. 21, 2017

(30) Foreign Application Priority Data

Jun. 15, 2016 (CN) ..... 2016 1 0421987

(51) Int. Cl.

| | |
|---|---|
| ***B22C 9/28*** | (2006.01) |
| ***B22C 9/06*** | (2006.01) |
| ***B22D 18/04*** | (2006.01) |

(52) U.S. Cl.

CPC ..... *B22C 9/28* (2013.01); *B22D 18/04* (2013.01); *H05K 999/99* (2013.01)

(58) Field of Classification Search

CPC ..... B22C 9/065; B22C 9/28; B22D 18/04

See application file for complete search history.

(56) References Cited

U.S. PATENT DOCUMENTS

| | | | | | |
|---|---|---|---|---|---|
| 5,647,426 | A | * | 7/1997 | Prieto | B22C 9/28 164/122.1 |
| 5,896,912 | A | * | 4/1999 | Monroe | B22C 9/28 164/119 |
| 2004/0194906 | A1 | | 10/2004 | Baumgartner | |

FOREIGN PATENT DOCUMENTS

| | | | | |
|---|---|---|---|---|
| CN | 202097389 | U | | 1/2012 |
| CN | 202506827 | U | * | 10/2012 |
| CN | 103488213 | A | * | 1/2014 |
| CN | 204171338 | U | | 2/2015 |
| CN | 204770603 | U | | 11/2015 |
| CN | 205217936 | U | | 5/2016 |
| CN | 205289665 | U | | 6/2016 |
| CN | 205673567 | U | | 11/2016 |
| JP | 2598974 | B2 | | 4/1997 |
| JP | 2002283035 | A | | 10/2002 |
| JP | 4395819 | B2 | | 1/2010 |

* cited by examiner

*Primary Examiner* — Kevin E Yoon

(74) *Attorney, Agent, or Firm* — Cooper Legal Group, LLC

(57) ABSTRACT

A low-pressure casting bottom mold for an aluminum alloy hub is provided. The low-pressure casting bottom mold for the aluminum alloy hub is composed of an upper surface facing a cavity and a lower surface facing a die casting platform, wherein the bottom mold lower surface facing the die casting platform comprises an iron sheet cover, the iron sheet cover is fixed at a position, corresponding to a wheel spoke, of the bottom mold lower surface, and a sealed space is formed between the iron sheet cover and the bottom mold lower surface in a surrounding manner; the iron sheet cover comprises air inlets at one side close to a wheel center and air outlets at one side close to a rim; and the air inlets are connected with air tubes.

6 Claims, 1 Drawing Sheet

LOW-PRESSURE CASTING BOTTOM MOLD FOR ALUMINUM ALLOY HUB

CROSS-REFERENCE TO RELATED APPLICATIONS

This application is filed based upon and claims priority to Chinese Patent Application No. 201610421987.3, filed on Jun. 15, 2016, the entire contents of which are incorporated herein by reference.

TECHNICAL FIELD

The disclosure relates to the field of automobile components, and in particular to a low-pressure casting bottom mold for an aluminum alloy hub.

BACKGROUND

An aluminum alloy hub is one of important appearance components on a vehicle, so each automobile manufacturer establishes extremely strict standards for the quality of the front face of the hub, and it requires that the surfaces of products after a coating process cannot have any quality defects. At present, the aluminum alloy hub mainly utilizes a low-pressure casting forming technique, so defects, such as white spots, segregation and the like, usually occur on the surfaces of finish turned products during actual production, which belongs to a remarkable apparent defect problem; and the products with these defects occupy a large proportion of production wastes. Field analysis suggests that the main reason for these defects is cooling nonuniformity of the bottom mold. The existing bottom mold mainly utilizes a point cooling manner, cooling points in such cooling manner are constant, and the mold temperature of parts corresponding to air tubes is quickly reduced; meanwhile, a temperature distribution trend gradually increasing from the center of each cooling point to the outside is formed, but no stable and uniform temperature gradient is formed on the surface of the whole mold; therefore, a local feeding insufficiency situation occurs, and finally, these defects, such as the white spots, the segregation and the like, occur on slowly cooled parts of a casting, resulting in production wastes directly.

By combining the above-mentioned analysis, it is necessary to optimize and improve the existing mold cooling structure during production in order to solve the problem that the defects, such as the white spots, the segregation and the like, are liable to occur on the surface of the hub; and due to effective control on a casting process, the appearance quality of the final products is improved, and the rejection rate is reduced.

SUMMARY

An improved cooling structure for a low-pressure casting wheel bottom mold is provided. Due to such cooling structure, temperature distribution of the bottom mold is more uniform and reasonable, and an excellent temperature gradient is formed, thereby solving a problem that defects, such as white spots, segregation and the like, are liable to occur on products, improving the appearance quality of a hub and increasing the yield of the products.

In one aspect of the disclosure, a low-pressure casting bottom mold for an aluminum alloy hub is provided. The low-pressure casting bottom mold for the aluminum alloy hub is composed of an upper surface facing a cavity and a lower surface facing a die casting platform, in which the bottom mold lower surface facing the die casting platform comprises an iron sheet cover (21), the iron sheet cover is fixed at a position, corresponding to a wheel spoke, of the bottom mold lower surface, and a sealed space is formed between the iron sheet cover (21) and the bottom mold lower surface in a surrounding manner; the iron sheet cover (21) comprises air inlets (23) at one side close to a wheel center and air outlets (24) at one side close to a rim; and the air inlets (23) are connected with air tubes (22).

In one preferable aspect of the disclosure, the iron sheet cover (21) is fixed to the bottom mold lower surface in a welding manner.

In one preferable aspect of the disclosure, the distance between the iron sheet cover (22) and the bottom mold lower surface is 10-20 mm.

In one preferable aspect of the disclosure, the thickness of the iron sheet cover (22) is 1-3 mm.

In one preferable aspect of the disclosure, the thickness of the iron sheet cover (22) is 2 mm.

In one preferable aspect of the disclosure, the number of the air inlets (23) is 1-3.

In other aspects of the disclosure, arrangement of air tubes in the existing structure casting wheel bottom mold is improved, wherein the former cooling air holes are cancelled, and a layer of iron sheet with the thickness of 2 mm is welded on an area corresponding to a spoke; a certain interval needs to be reserved between the iron sheet and the mold surface, preferably 10-20 mm; an inner end face and an outer end face of the welded iron sheet are perforated, holes in the outer end face are air tube insertion holes, the number of the holes is consistent with the number of air paws, and holes in the inner end face are utilized as air discharging channels, thereby forming an air flowing channel from the periphery to the center; and air tubes are arranged at the root of a bottom mold outer-side spoke, the positions of the air paws correspond to a cavity formed by the iron sheet and the bottom mold, and the number of the air paws depends on the shape of the spoke and is set to 1-3 according to the width of the spoke. Due to such improvement design, when cooling air starts, compressed air flows in the cavity from outside to inside, and the cooling effect is gradually weakened, so that a temperature gradient increasing from the spoke root to the center is formed, which greatly facilitates the feeding of molten aluminum; and meanwhile, uniform and stable surface cooling instead of the original point cooling manner is formed on the whole spoke area, so that a local super-cooling situation does not occur on the surface of a casting. Therefore, a problem that white spots, segregation and the like are liable to occur on the surfaces of wheel products is solved, and the product quality and the yield are improved largely.

The low-pressure casting bottom mold for the aluminum alloy hub has a simple structure; due to improvement on the existing bottom mold cooling structure, the uniform and stable surface cooling and the temperature gradient increasing from the spoke root to the center can be formed on the surface of the mold; therefore, the feeding capacity of the spoke is remarkably reinforced, the solidification rate of each part of a casting is consistent with each other, defects, such as white spots, segregation and the like, occurring on the surface of the hub are eliminated, and the product quality and the yield are further improved.

BRIEF DESCRIPTION OF THE DRAWINGS

The following describes embodiments of the disclosure in details with the accompanying drawings, wherein.

In the figures, numeric symbols are as follows: 11—bottom mold, 12—point cooling air, 21—iron sheet, 22—air tube, 23—air inlet, and 24—air outlet.

DETAILED DESCRIPTION

Embodiment 1

Figure 1:
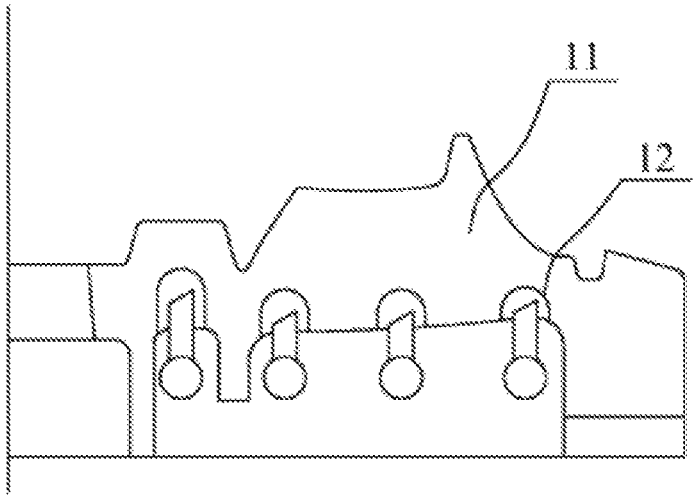
FIG. 1 is a schematic diagram of cooling arrangement of a low-pressure casting wheel bottom mold in the prior art.

The FIG. 1 is a cooling arrangement form of a low-pressure casting wheel bottom mold in the prior art.

Figure 2:
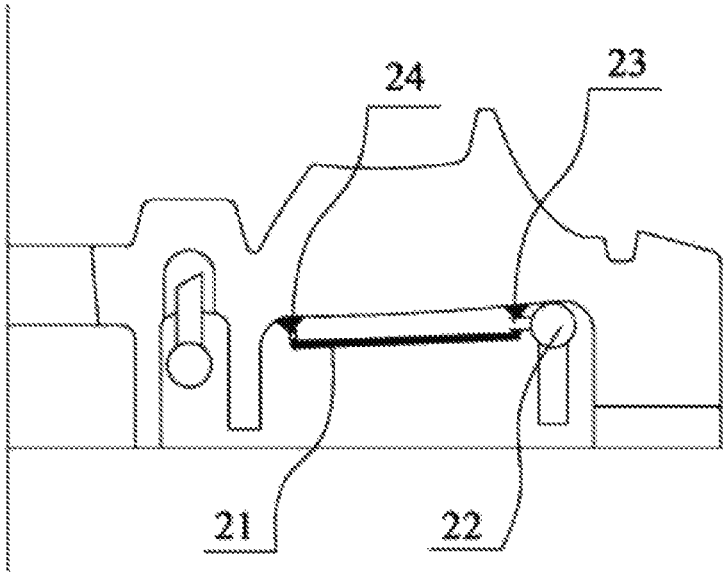
Prior art Fig. 2
FIG. 2 is a schematic diagram of an improved cooling scheme of a low-pressure casting wheel bottom mold provided by the disclosure.

The FIG. 2 is an improved cooling structure of a low-pressure casting wheel bottom mold provided by the disclosure, wherein the former cooling air holes are cancelled, and a layer of iron sheet (21) with the thickness of 2 mm is welded on an area corresponding to a spoke; an interval of 15 mm needs to be reserved between the iron sheet (21) and the mold surface; small holes are formed in an inner end face and an outer end face of the welded iron sheet, the small holes in the outer end face are air paw insertion holes (23), and the small holes in the inner end face are air discharging holes (24), thereby forming an air flowing channel from the periphery to the center; and air tubes (22) are arranged at the root of a bottom mold outer-side spoke, the positions of the air paws correspond to a cavity formed by the iron sheet and the bottom mold, and the number of the air paws is set to 3 according to the width of the spoke. Due to such improvement design, when cooling air starts, compressed air flows in the cavity from outside to inside, so that a temperature gradient increasing from the spoke root to the center is formed, which greatly facilitates the feeding of molten aluminum; and meanwhile, uniform and stable surface cooling instead of the original point cooling manner is formed on the whole spoke area.

Pilot production is performed in a research and development workshop located in the engineering technology institute of CITIC Dicastal Co., Ltd. According to the embodiment 1 provided by the disclosure, a low-pressure casting mold is modified, and casting is performed on three low-pressure casting machines. By comparison, a local super-cooling situation does not occur on the surfaces of castings any longer. Therefore, the problem that white spots, segregation and the like are liable to occur on the surfaces of wheel products is solved radically, and the product quality and the yield are improved largely.

What is claimed is:

1. A low-pressure casting bottom mold for an aluminum alloy hub, comprising an upper surface facing a cavity and a lower surface facing a die casting platform, wherein the bottom mold lower surface facing the die casting platform comprises an iron sheet cover, the iron sheet cover is fixed at a position, corresponding to a wheel spoke, of the bottom mold lower surface, and a sealed space is formed between the iron sheet cover and the bottom mold lower surface in a surrounding manner; the iron sheet cover comprises air inlets at one side closer to a rim than a wheel center and air outlets at one side closer to the wheel center than the rim; and the air inlets are connected with air tubes.

2. The low-pressure casting bottom mold for the aluminum alloy hub according to claim 1, wherein the iron sheet cover is fixed to the bottom mold lower surface in a welding manner.

3. The low-pressure casting bottom mold for the aluminum alloy hub according to claim 1, wherein the distance between the iron sheet cover and the bottom mold lower surface is 10-20 mm.

4. The low-pressure casting bottom mold for the aluminum alloy hub according to claim 1, wherein the thickness of the iron sheet cover is 1-3 mm.

5. The low-pressure casting bottom mold for the aluminum alloy hub according to claim 4, wherein the thickness of the iron sheet cover is 2 mm.

6. The low-pressure casting bottom mold for the aluminum alloy hub according to claim 1, wherein the number of the air inlets is 1-3.

* * * * *